United States Patent [19]

Hockett

[11] Patent Number: 4,815,709

[45] Date of Patent: Mar. 28, 1989

[54] SAILING WINCH AND HANDLE THEREFOR

[76] Inventor: Alwyn C. Hockett, 6379 Clara Lee Ave., San Diego, Calif. 92120

[21] Appl. No.: 230,301

[22] Filed: Aug. 9, 1988

[51] Int. Cl.[4] ..... B66D 1/30; B66D 3/04

[52] U.S. Cl. ..... 254/264; 254/371; 254/391

[58] Field of Search ..... 254/199, 213, 223, 243, 254/250, 251, 252, 256, 257, 266, 264, 371, 376, 390, 391, 369; 114/102, 109, 218, 268; 74/138, 141

[56] References Cited

U.S. PATENT DOCUMENTS

| | | | |
|---|---|---|---|
| 255,033 | 3/1882 | Salisbury | 254/225 X |
| 1,893,727 | 1/1933 | Wood | 254/369 |
| 2,658,720 | 11/1953 | Coffing | 254/250 X |
| 3,051,445 | 8/1962 | Moulton | 254/213 |
| 3,455,081 | 7/1969 | Lund | 254/251 X |
| 3,770,244 | 11/1973 | McCloud | 254/252 X |
| 3,910,557 | 10/1975 | Merriman | 254/369 |
| 4,215,643 | 8/1980 | Jefferies et al. | 254/376 X |
| 4,293,121 | 10/1981 | Wallin | 254/370 |

FOREIGN PATENT DOCUMENTS

| | | | |
|---|---|---|---|
| 652461 | 11/1985 | Switzerland | 254/243 |

*Primary Examiner*—Joseph J. Hail, III

*Attorney, Agent, or Firm*—Charles C. Logan, II

[57] ABSTRACT

The winch has a disc-shaped hub having a shaft extending upwardly from its top surface. It also has a winch drum having an axial bore whose diameter is sized to rotatably receive the shaft of the disc-shaped hub. The bottom end of the winch drum has a recess with ratchet teeth formed around its inner annular surface and there are a pair of pawl members in spring loaded attachment with the outer surface of the shaft of the disc-shaped hub to form a ratchet assembly. There is a bore hole in the bottom end of the disc-shaped hub and an upright extending secondary shaft member has its top end rotatably inserted into this bore hole. A handle has its one end secured to the secondary shaft and it extends radially therefrom and has a supporting block mounted on its opposite end and a double cam cleat is mounted thereon. An alternative form of handle is also operable with the same basic winch structure but does not require the handle to be permanently secured to the winch. This handle is in the form of an elongated lever member having a yoke portion formed on one end thereof. A pad eye is mounted on the top surface of the elongated lever member through-which will pass a sailing line and a double cam cleat assembly is mounted adjacent to the pad eye.

4 Claims, 1 Drawing Sheet

SAILING WINCH AND HANDLE THEREFOR

BACKGROUND OF THE INVENTION

The invention relates to a winch apparatus and more specifically to a winch assembly adaptable for use on small water craft such as sailboats; and will be described with respect thereto, though the invention is not necessarily limited to such field of use.

In effecting operations of a sail boat, the sail, in addition to other factors, must be constantly manipulated with respect to prevailing wind conditions, as for example when prevailing wind conditions change, or the helmsman wants to change course.

This is conventionally accomplished by wrapping a boomline several turns around a winch drum, and drawing in or relaxing the line depending on the position or change desired, following winch, the free or loose end of the line is hitched to a near post or conventional cleat, to hold the sail position until another change is desired.

When such change is deemed necessary, either by reason of a change in wind conditions or a desire to change course, the time factor usually becomes important, as the change in sail position must be effected rapidly, and if the operator has to divide his attention and his movements between a winch at one location and a hitch or cleat at another location the speed at which changes may be made is adversely affected. One of the major problems that has existed during this crucial period of time results from the fact that a winch handle is generally inserted into the top of winch in order to winch in the sail line to a proper degree. Too often in the excitement of the moment, such a handle is dropped overboard which not only results in the loss of the handle for the operation of winching in the line, but results in considerable expense to the owner of the sail boat.

It is an object of the invention to provide a novel winch structure which has the winching handle permanently attached to the winch assembly.

It is also an object of the invention to provide a novel winch having the winch handle connected to the winch in such a manner that it does not create problems in fouling the sail line that is passing around the winch.

It is another object of the invention to provide a novel winch having a handle permanently attached to the winch which also has cam cleat structure on the handle for securing the sail line.

It is a further object of the invention to provide an alternative form of handle which can be used with the basic winch structure which works in a manner different from previously known detachable handles.

SUMMARY OF THE INVENTION

The novel winch is attached to the top surface of a sail boat by a base plate that acts as a spacer member. A disc-shaped hub having a shaft extending upwardly from its top surface has its bottom surface secured to the top surface of the base plate. A winch drum having an axial bore whose diameter is sized to rotatably receive the shaft of the disc-shaped hub slips over the top of the aforementioned shaft. The bottom end of the winch drum has a recess therein with ratchet teeth fromed around its inner annular surface and a pair of pawl members in spring loaded attachment with the outer surface of the shaft of the disc-shaped hub form a ratchet structure. A bore hole in the bottom end of the discshaped hub receives an upright extending secondary shaft member hub receives an upright extending secondary shaft member whose top end is rotatably inserted into the bore hole. A handle has its one end secured to the secondary shaft and it extends radially therefrom and has a supporting block mounted on its opposite end. A double cam cleat assembly is mounted on the top surface of the supporting block.

The operation of the novel winch begins by the wrapping of a boom line or sail line several turns around the winch drum and then securing the line in the double cam cleat assembly mounted on the handle. The operator then grips the line with his left hand at the point where it exits the double cam cleat assembly and applies a clockwise movement to the handle which forces the winch to operate in a clockwise direction with a mechanical advantage. By using his right hand on the end of the handle during its clockwise travel, the operator obtains twice the amount of normal torque. It is the advancing movement of the line wound tight against the drum that causes the drum to rotate and the winch is not caused to rotate by the movement of the handle. The motion of the handle causes the line to advance around the perimeter of the drum. At the end of the normal clockwise movement of the handle the free end of the line is tailed inwardly by the operator by his left hand thereby gaining the stray amount of line, and the handle is then rotated in a counter-clockwise direction to begin the operation again. One hand operation may crank and tail the winch, however, the heel of the other hand may be forced against the cam cleat where greater torque is required. The ratchet mechanism of the winch prevents the winch drum from rotating counterclockwise when the handle is rotated in that direction. Continued clockwise motion of the handle along with its return to the original position will cause the sail line to be drawn into its proper degree of tension. The location of the double cam clear assembly allows the winching operation to be performed in close coordination with the cleating operation thereby preventing the sail line from slipping off of the winch. When it is desired to release the sail line, the only movement necessary is to quickly lift the line upwardly out of the double cam cleat assembly and throw the line off.

The alternative manner of performing the same function as discussed above with the same winch can be done with the applicant's novel winching handle. In this operation the winch handle is not permanently secured to the winch. In a manner similar to the previously discussed operation, the boom line or sail line would be wrapped one or two turns around the winch drum and then it would pass through the fair lead or pad eye mounted on the top surface of the handle and then through the double cam cleat assembly mounted adjacent thereto. To operate the handle, the operator positions the yoke of the handle in contact with the winch drum and makes a clockwise rotational movement of the handle. This motion of the handle will cause the rop to advance around the perimeter of the drum and this advancing movement of the rope wound tight against the drum causes the drum to rotate. The ratchet mechanism will prevent the reverse counter-clockwise motion of the drum when the handle is rotated in a counter-clockwise direction. During this counter-clockwise movement the free end of the sail line is tailed by the left hand of the operator thereby taking up the amount of advancement of the sail line. Continued cranking motion such as described above will draw in the sail line to the desired degree of tension. When it is desired to release the sail line, all that is necessary is a upward motion on the sail line to withdraw it from the double cam cleat assembly and the line is free to unwind off of the winch or be unwound by the operator. The handle is retained on the line where it may be quickly installed for use. The handle does not constitute interference as it is at anytime located where the line is and presents no more interference than the line would.

Use of conventional winches requires that several turns of line be placed on the winch in order to provide braking friction from the line to winch drum in order that cranking will bring in the line. Time is required to install the turns of line and also to throw off all but one or so turns in order to eliminate this line to drum friction when it is desired to pay out the line.

Drum operation accomplished by advancing in applicant's winch may be obtained by installing a single turn of the drum. Drum to line friction is not used for the inhaul phase. Friction is used in the tailing phase. The winch drum having but a single turn is primed for a quick payout, and is also ready for an inhaul without installation of additional turns.

DESCRIPTION OF THE PREFERRED EMBODIMENT

Figure 2:
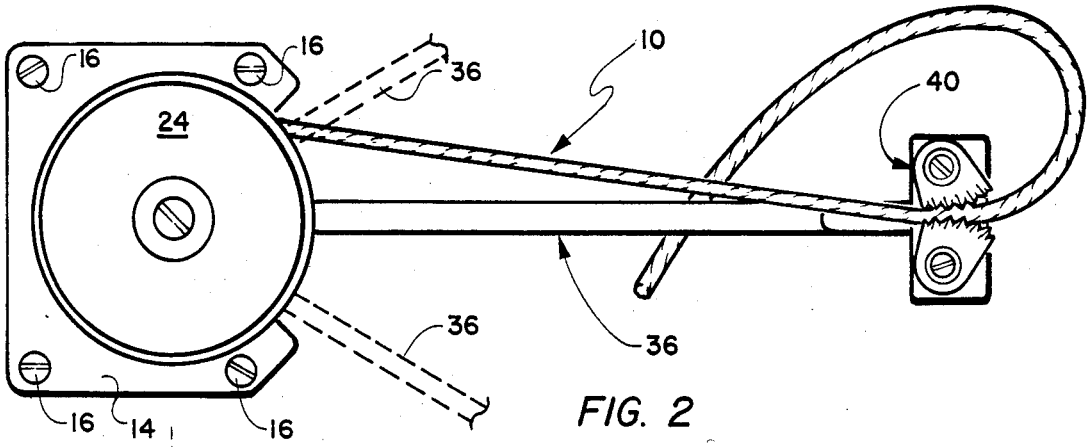
FIG. 2 is a top plan view of the novel winch.
Figure 1:
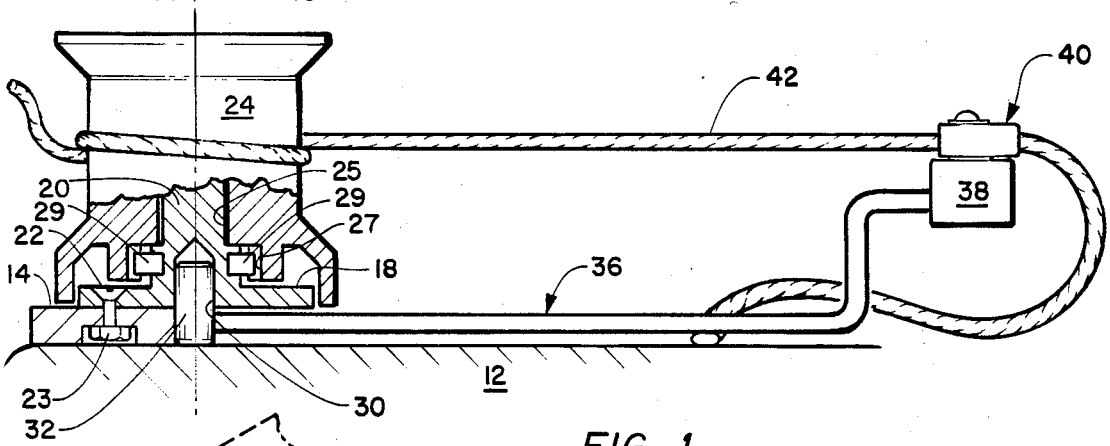
FIG. 1 is a side elevation view of the novel winch with portions broken away for clarity.

The novel winch assembly will be best described by referring to FIGS. 1 & 2. The winch assembly is generally designated numeral 10. It is mounted on the top surface 12 of a sailboat. A base plate 14 is attached to the top surface 12 by screws 16. A disc-shaped hub 18 has a shaft 20 extending upwardly from its top surface. Disc-shaped hub 18 has its bottom surface secured to the top surface of base plate 14 by bolts 22 and nuts 23. A winch drum 24 has an axial bore 25 sized to rotatatably receive the shaft 20 of disc-shaped hub 18. The bottom end of winch drum 24 has a recess with ratchet teeth 27 formed around its inner annular surface. A pair of pawl members 29 are in spring loaded attachment with the outer surface of shaft 20 of the disc-shaped hub 18.

A bore hole 30 is formed in the bottom end of disc-shaped hub 18 and upright extending secondary shaft member 32 has its top end rotatably inserted into bore hole 30.

A radially extending handle 36 has its one end secured to secondary shaft member 32 and it has a supporting lock 38 mounted on its opposite end. A double cam cleat assembly 40 is mounted on the top surface of supporting lock 38. The sail line 42 is shown to pass around winch drum 24 and be secured in the double cam cleat assembly 40. The dotted lines 36' prime denote the maximum range of travel of handle 36.

Figure 4:
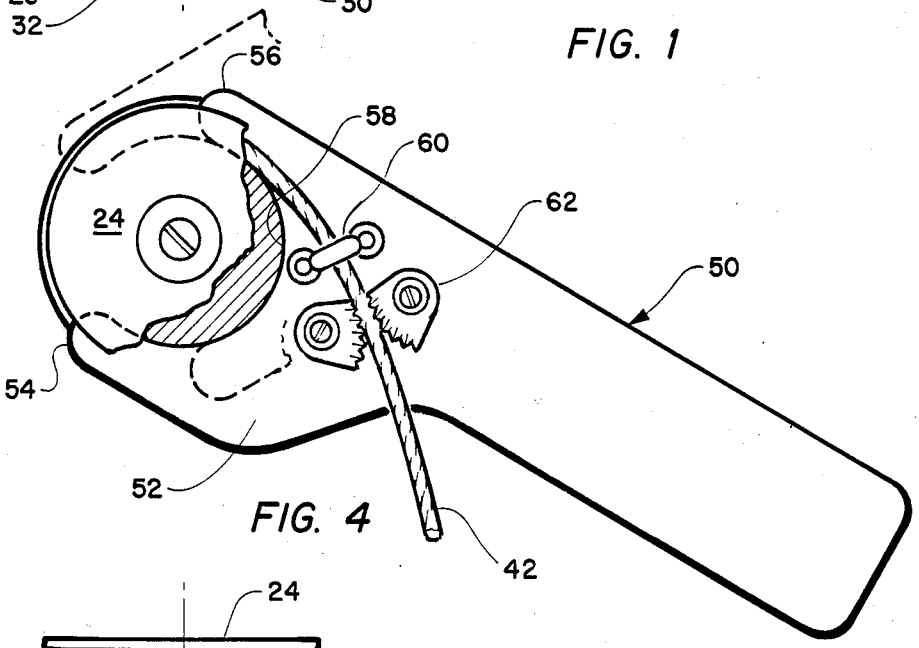
FIG. 4 is a top plan view of the alternative handle for the winch assembly.
Figure 3:
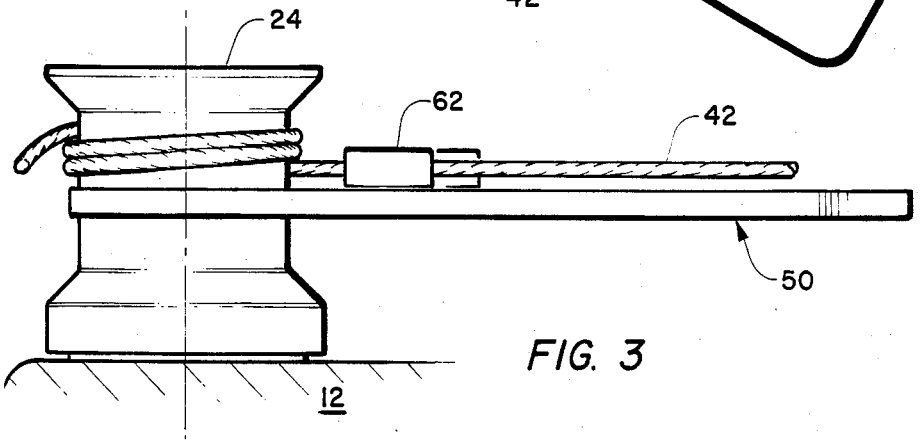
FIG. 3 is a side elevation view of an alternative form of handle for the winch.

The alternative form of handle is illustrated in FIGS. 3 & 4 and generally designated numeral 50. Handle 50 is in the form of an elongated lever member having a yoke portion 52 fromed at its one end by finger members 54 and 56 and the concave arcuate end edge 58 therebetween. A fairlead 60 or pad eye is mounted on the top surface of handle 50 and adjacent thereto is a double cam cleat assembly 64. The sailing line is illustrated as passing through pad eye 60 and then through double cam cleat assembly 62. The winch assembly used with the alternative handle would be substantially identical to the winch assembly illustrated in FIGS. 1 & 2 with the absence of the handle 36 and its structure which has been incorporated into the bottom of the winch for attaching the handle in a pivotal relationship.

What is claimed is:

1. A winch for use on a sailboat comprising:

a base plate adapter to be rigidly affixed to said boat;

a disc-shaped hub having a shaft extending upwardly from its top surface, said disc-shaped hub having its bottom surface fixed to the top surface of said base plate;

a winch drum having an axial bore whose diameter is sized to rotatably receive the shaft of said disc-shaped hub, the bottom end of said drum having a recess with ratchet teeth formed around its inner annular surface; at least one pawl member biased against the outer surface of the shaft of said disc-shaped hub; and a bore hole in the bottom end of said disc-shaped hub, an upright extending secondary shaft member having its top end rotatably inserted into said bore hole, a radially extending handle having its one end fixed to said secondary shaft and having a supporting block mounted on its opposite end, a double cam cleat assembly is rotated on the top surface of said supporting block.

2. A winch as recited in claim 1 wherein the end of secondary shaft having the supporting block mounted thereon in vertically offset from the opposite end of said secondary shaft.

3. A winch as recited in claim 2 wherein said winch drum has a downwardly extending annular flange whose diameter is greater than that of said disc-shaped hub and the lower end of said downwardly extending flange is lower than the top surface of said disc-shaped hub.

4. A winch as recited in claim 1 wherein the bottom end of said secondary shaft is rotatably supported in a bore hole formed in the top surface of the structure to which said base plate is secured.

* * * * *